US008220638B2

(12) United States Patent
Kuroda et al.

(10) Patent No.: US 8,220,638 B2
(45) Date of Patent: Jul. 17, 2012

(54) CURRENCY SORTER

(75) Inventors: Akito Kuroda, Himeji (JP); Kenichi Hattori, Himeji (JP); Kenji Hirosawa, Himeji (JP)

(73) Assignee: Glory Kogyo Kabushiki Kaisha, Hyogo-Ken (JP)

( * ) Notice: Subject to any disclaimer, the term of this patent is extended or adjusted under 35 U.S.C. 154(b) by 123 days.

(21) Appl. No.: 11/243,231

(22) Filed: Oct. 4, 2005

(65) Prior Publication Data

US 2006/0076212 A1 Apr. 13, 2006

(30) Foreign Application Priority Data

Oct. 4, 2004 (JP) ..... 2004-291853
Oct. 6, 2004 (JP) ..... 2004-294177
Oct. 6, 2004 (JP) ..... 2004-294192

(51) Int. Cl.
*B07C 5/00* (2006.01)

(52) U.S. Cl. ..... 209/534; 194/206

(58) Field of Classification Search ..... 209/534; 194/206, 207

See application file for complete search history.

(56) References Cited

U.S. PATENT DOCUMENTS

| | | | | |
|---|---|---|---|---|
| 5,295,196 | A * | 3/1994 | Raterman et al. | 382/135 |
| 5,468,941 | A * | 11/1995 | Sasaki | 235/379 |
| 5,522,511 | A * | 6/1996 | Sakoguchi et al. | 209/534 |
| 2003/0168308 | A1* | 9/2003 | Maier et al. | 194/207 |
| 2004/0154964 | A1* | 8/2004 | Jones | 209/534 |
| 2004/0182675 | A1* | 9/2004 | Long et al. | 194/206 |

FOREIGN PATENT DOCUMENTS

| | | |
|---|---|---|
| EP | 0 430 679 A | 6/1991 |
| EP | 1 643 462 A | 4/2006 |
| JP | 61-239390 | 10/1986 |
| JP | 11 149582 | 6/1999 |
| JP | 2002 197509 | 7/2002 |
| JP | 2002 197510 | 7/2002 |
| JP | 2003-216999 | 7/2003 |
| JP | 2004-252941 | 9/2004 |

OTHER PUBLICATIONS

European Patent Office, Patent Abstracts of Japan, Publication No. 2002197509, published Jul. 2002 by Watanabe Hajime for Bill Rearranging Device.

European Search Report dated Mar. 2006 for Application No. 05256193.3-2211, Applicant: Glory Kogyo Kabushiki Kaisha.

European Search Report dated Mar. 16, 2007.

(Continued)

*Primary Examiner* — Joseph C Rodriguez
*Assistant Examiner* — Kalyanavenkateshware Kumar
(74) *Attorney, Agent, or Firm* — Renner, Kenner, Greive, Bobak, Taylor & Weber

(57) ABSTRACT

A currency sorter includes: take-in means (101) for taking currency notes in the sorter one by one; discriminating means (105) for discriminating the currency notes according to new and old versions, fit and unfit conditions, denominations and other categories; a plurality of stacking units (111 to 115) for stacking the currency notes of a predetermined category/categories designated to be bundled according to the discrimination results obtained by said discriminating means; designating means (11) for designating the category/categories of the notes to be bundled and a mode of sorting the notes to leave unbundled; and control means (400) for controlling allocation of currency notes discriminated by said discrimination means to said stacking units according to a designation by said designating means.

3 Claims, 17 Drawing Sheets

OTHER PUBLICATIONS

European Patent Office, Patent Abstracts of Japan, Publication No. 2002197510, published Jul. 2002 by Watanabe Hiroshi for Device and Method for Processing Paper Sheet.

European Patent Office, Patent Abstracts of Japan, Publication No. 11149582, published Jun. 1999 by Nemoto Yukihiro for Automatic Teller Machine.

European Patent Office, European Patent Application, Publication No. EP1643462A2, published Apr. 2006 by Akito Kuroda, et al. for Currency Sorter.

European Patent Office, European Patent Application, Publication No. 0430679A2, published Nov. 1990 by James Swinton, et al. for Depository Apparatus for Envelopes and Single Sheets.

European Search Report (Oct. 24, 2008—6 pages).

Chinese Office Action issued Mar. 16, 2011 (with English Translation) (7 pages).

Japanese Office Action in JP 2004-294177 issued Jul. 23, 2010 with English Translation (4 pages).

Japanese Office Action in JP 2004-294192 issued Jul. 23, 2010 with English Translation (4 pages).

* cited by examiner

OLD VERSION TREATED AS NORMAL SELECTABLE DENOMINATION

| MODE | PROCESS | DENOMINATIONS | CONDITIONS | VERSIONS | EXTERNAL STACKING UNIT |
|---|---|---|---|---|---|
| BUNDLING (DEFAULT) | 1 DENOMINATION | 1 OUT OF 4 (10000, 5000, 2000, 1000) DEFAULT: 10000 | SELECT ONE FROM (FIT / UNFIT, MIXED FIT, MIXED UNFIT) DEFAULT: FIT | SELECT ONE FROM (NEW, OLD, NEW AND OLD) DEFAULT: NEW | SELECT ONE FROM MIXED, DISCRIMINATIVE FIT / UNFIT, DISCRIMINATIVE NEW / OLD DEFAULT: MIXED |
| | 2 DENOMINATIONS | 2 OUT OF 4 (10000, 5000, 2000, 1000) DEFAULT: 10000 AND 1000 | | | |
| | 3 DENOMINATIONS | 3 OUT OF 4 (10000, 5000, 2000, 1000) DEFAULT: 10000, 5000 AND 1000 | | | |
| | 4 DENOMINATIONS (DEFAULT) | 10000, 5000, 2000 AND 1000 ARE SELECTED | | | |

FIG. 3

OLD VERSION TREATED AS NORMAL DIRECT BUNDLING SELECTION

| MODE | PROCESS | DENOMINATIONS | CONDITIONS | VERSIONS | EXTERNAL STACKING UNIT |
|---|---|---|---|---|---|
| BUNDLING (DEFAULT) | 1 DENOMINATION FIT / UNFIT | 1 OUT OF 4 (10000, 5000, 2000, 1000) DEFAULT: 10000 | NOT SELECTABLE (PRESSING IMPOSSIBLE) | SELECT ONE FROM (NEW, OLD, NEW AND OLD) DEFAULT: NEW | SELECT ONE FROM MIXED, DISCRIMINATIVE FIT / UNFIT, DISCRIMINATIVE NEW / OLD DEFAULT: MIXED |
| | 2 DENOMINATIONS FIT / UNFIT | 2 OUT OF 4 (10000, 5000, 2000, 1000) DEFAULT: 10000 AND 1000 | | | |
| | 1 DENOMINATION NEW / OLD | 1 OUT OF 3 (10000, 5000, 1000) DEFAULT: 10000 | SELECT ONE FROM (FIT / UNFIT, MIXED FIT, AND MIXED UNFIT) DEFAULT: FIT | NOT SELECTABLE (PRESSING IMPOSSIBLE) | |
| | 2 DENOMINATIONS NEW / OLD | 2 OUT OF 3 (10000, 5000, 1000) DEFAULT: 10000 AND 1000 | | | |
| | SECOND FIT / UNFIT | 2 OUT OF 4 (10000, 5000, 2000, 1000) DEFAULT: 10000 AND 1000 | NOT SELECTABLE (PRESSING IMPOSSIBLE) | SELECT ONE FROM (NEW, OLD, NEW AND OLD) DEFAULT: NEW | |

FIG. 4

OLD VERSION TREATED AS NORMAL NO BUNDLING

| MODE | PROCESS | DENOMINATIONS | CONDITIONS | VERSIONS | EXTERNAL STACKING UNIT |
|---|---|---|---|---|---|
| ENTRY | SORTING (DEFAULT) | 1 OUT OF 4 (10000, 5000,2000, 1000)<br>DEFAULT: 10000 | NOT SELECTABLE (PRESSING IMPOSSIBLE)<br>※ MIXED FIT / UNFIT OTHER THAN FIT / UNFIT | SELECT ONE FROM (NEW, OLD, NEW / OLD)<br>DEFAULT: NEW | NOT SELECTABLE (PRESSING IMPOSSIBLE) |
| | MIXED | NOT SELECTABLE (PRESSING IMPOSSIBLE) ※ MIXED DENOMINATION ONLY | | | |
| | FIT / UNFIT | | | NOT SELECTABLE (PRESSING IMPOSSIBLE) | |
| | NEW / OLD | | | | |
| BATCH | SETTING OF NOS. OF NOTES: ENTRY BY KEY<br>DEFAULT: 150 | 1 OUT OF 5 (AUTOMATIC, 10000, 5000, 2000, 1000)<br>DEFAULT: AUTOMATIC | SELECT ONE FROM (FIT / UNFIT ON, FIT / UNFIT OFF)<br>DEFAULT: FIT / UNFIT ON | SELECT ONE FROM (NEW, OLD, NEW / OLD)<br>DEFAULT: NEW | |

FIG. 5

OLD VERSION TREATED AS REJECT NOTE SELECTABLE DENOMINATION

| MODE | PROCESS | DENOMINATIONS | CONDITIONS | VERSIONS | EXTERNAL STACKING UNIT |
|---|---|---|---|---|---|
| BUNDLING (DEFAULT) | 1 DENOMINATION | 1 OUT OF 4 (10000, 5000, 2000, 1000) DEFAULT: 10000 | SELECT ONE FROM (FIT / UNFIT, MIXED FIT, MIXED UNFIT) DEFAULT: FIT | NOT SELECTABLE FIXED TO NEW NOTE | SELECT ONE FROM MIXED, DISCRIMINATIVE FIT / UNFIT, DISCRIMINATIVE NEW / OLD DEFAULT: MIXED |
| | 2 DENOMINATIONS | 2 OUT OF 4 (10000, 5000, 2000, 1000) DEFAULT: 10000 AND 1000 | | | |
| | 3 DENOMINATIONS | 3 OUT OF 4 (10000, 5000, 2000, 1000) DEFAULT: 10000, 5000 AND 1000 | | | |
| | 4 DENOMINATIONS (DEFAULT) | 10000, 5000, 2000 AND 1000 ARE SELECTED | | | |

FIG. 6

OLD VERSION TREATED AS REJECT NOTE DIRECT BUNDLING SELECTION

| MODE | PROCESS | DENOMINATIONS | CONDITIONS | VERSIONS | EXTERNAL STACKING UNIT |
|---|---|---|---|---|---|
| BUNDLING (DEFAULT) | 1 DENOMINATION FIT / UNFIT | 1 OUT OF 4 (10000, 5000, 2000, 1000) DEFAULT: 10000 | NOT SELECTABLE (PRESSING IMPOSSIBLE) | NOT SELECTABLE FIXED TO NEW NOTES | SELECT ONE FROM MIXED, DISCRIMINATIVE FIT / UNFIT, DISCRIMINATIVE NEW / OLD<br>DEFAULT: MIXED |
| | 2 DENOMINATIONS FIT / UNFIT | 2 OUT OF 4 (10000, 5000, 2000, 1000) DEFAULT: 10000 AND 1000 | | | |
| | 1 DENOMINATION NEW / OLD PRESSING OF SELECTION BUTTON IMPOSSIBLE | — | — | — | |
| | 2 DENOMINATIONS NEW / OLD PRESSING OF SELECTION BUTTON IMPOSSIBLE | — | — | — | |
| | SECOND FIT / UNFIT | 2 OUT OF 4 (10000, 5000, 2000, 1000) DEFAULT: 10000 AND 1000 | NOT SELECTABLE (PRESSING IMPOSSIBLE) | NOT SELECTABLE FIXED TO NEW NOTES | |

FIG. 7

OLD VERSION TREATED AS NORMAL NO BUNDLING

| MODE | PROCESS | DENOMINATIONS | CONDITIONS | VERSIONS | EXTERNAL STACKING UNIT |
|---|---|---|---|---|---|
| ENTRY | SORTING (DEFAULT) | 1 OUT OF 4 (10000, 5000,2000, 1000)<br>DEFAULT: 10000 | NOT SELECTABLE (PRESSING IMPOSSIBLE)<br>※ MIXED FIT / UNFIT OTHER THAN FIT / UNFIT | NOT SELECTABLE FIXED TO NEW NOTE | NOT SELECTABLE (PRESSING IMPOSSIBLE) |
| | MIXED | NOT SELECTABLE (PRESSING IMPOSSIBLE)<br>※ MIXED DENOMINATION ONLY | | | |
| | FIT / UNFIT | | | | |
| | NEW / OLD PRESSING OF SELECTION BUTTON IMPOSSIBLE | — | — | — | |
| BATCH | SETTING OF NOS. OF NOTES: ENTRY BY KEY<br>DEFAULT: 150 | 1 OUT OF 5 (AUTOMATIC, 10000, 5000, 2000, 1000)<br>DEFAULT: AUTOMATIC | SELECT ONE FROM (FIT / UNFIT ON, FIT / UNFIT OFF)<br>DEFAULT: FIT / UNFIT ON | NOT SELECTABLE FIXED TO NEW NOTE | |

FIG. 8

OLD VERSION TREATED AS NEW UNFIT DIRECT DENOMINATION SELECTION

| MODE | PROCESS | DENOMINATIONS | CONDITIONS | VERSIONS | EXTERNAL STACKING UNIT |
|---|---|---|---|---|---|
| BUNDLING (DEFAULT) | 1 DENOMINATION | 1 OUT OF 4 (10000, 5000, 2000, 1000) DEFAULT: 10000 | SELECT ONE FROM FIT / UNFIT, MIXED RIGHT, MIXED DAMAGED<br><br>DEFAULT: RIGHT | NOT SELECTABLE FIXED TO NEW / OLD NOTE | SELECT ONE FROM MIXED, DISCRIMINATIVE FIT / UNFIT, DISCRIMINATIVE NEW / OLD<br><br>DEFAULT: MIXED |
| | 2 DENOMINATIONS | 2 OUT OF 4 (10000, 5000, 2000, 1000) DEFAULT: 10000 AND 1000 | | | |
| | 3 DENOMINATIONS | 3 OUT OF 4 (10000, 5000, 2000, 1000) DEFAULT: 10000, 5000 AND 1000 | | | |
| | 4 DENOMINATIONS | 10000, 5000, 2000, 1000 ARE SELECTED | | | |

FIG. 9

OLD VERSION TREATED AS NEW UNFIT NOTE DIRECT BUNDLING SELECTION

| MODE | PROCESS | DENOMINATIONS | CONDITIONS | VERSIONS | EXTERNAL STACKING UNIT |
|---|---|---|---|---|---|
| BUNDLING (DEFAULT) | 1 DENOMINATION FIT / UNFIT | 1 OUT OF 4 (10000, 5000, 2000, 1000) DEFAULT: 10000 | NOT SELECTABLE (PRESSING IMPOSSIBLE) | NOT SELECTABLE FIXED TO NEW / OLD NOTES | SELECT ONE FROM MIXED, DISCRIMINATIVE FIT / UNFIT, DISCRIMINATIVE NEW / OLD<br>DEFAULT: MIXED |
| | 2 DENOMINATIONS FIT / UNFIT | 2 OUT OF 4 (10000, 5000, 2000, 1000) DEFAULT: 10000 AND 1000 | | | |
| | 1 DENOMINATION NEW / OLD PRESSING OF SELECTION BUTTON IMPOSSIBLE | — | — | — | |
| | 2 DENOMINATIONS NEW / OLD PRESSING OF SELECTION BUTTON IMPOSSIBLE | — | — | — | |
| | SECOND FIT / UNFIT | 2 OUT OF 4 (10000, 5000, 2000, 1000) DEFAULT: 10000 AND 1000 | NOT SELECTABLE (PRESSING IMPOSSIBLE) | NOT SELECTABLE FIXED TO NEW / NOTES | |

FIG.10

OLD VERSION TREATED AS NEW UNFIT NOTE NO BUNDLING

| MODE | PROCESS | DENOMINATIONS | CONDITIONS | VERSIONS | EXTERNAL STACKING UNIT |
|---|---|---|---|---|---|
| ENTRY | SORTING (DEFAULT) | 1 OUT OF 4 (10000, 5000,2000, 1000)<br>DEFAULT: 10000 | NOT SELECTABLE (PRESSING IMPOSSIBLE)<br>※ MIXED FIT / UNFIT OTHER THAN FIT / UNFIT MODE | NOT SELECTABLE (PRESSING IMPOSSIBLE) FIXED TO NEW / OLD NOTE | NOT SELECTABLE (PRESSING IMPOSSIBLE) |
| | MIXED | NOT SELECTABLE (PRESSING IMPOSSIBLE) ※ MIXED DENOMINATION ONLY | | | |
| | FIT / UNFIT | | | | |
| | NEW / OLD PRESSING OF SELECTION BUTTON IMPOSSIBLE | — | — | — | |
| BATCH | SETTING OF NOS. OF NOTES: ENTRY BY KEY<br>DEFAULT: 150 | 1 OUT OF 5 AUTOMATIC, 10000, 5000, 2000, 1000<br>DEFAULT: AUTOMATIC | SELECT ONE FROM (FIT / UNFIT ON, FIT / UNFIT OFF)<br>DEFAULT: FIT / UNFIT ON | NOT SELECTABLE (PRESSING IMPOSSIBLE) FIXED TO NEW / OLD NOTE | |

FIG.11

| CASE | 10000 | | | | 5000 | | | | 2000 | | | | 1000 | | | |
|---|---|---|---|---|---|---|---|---|---|---|---|---|---|---|---|---|
| | NEW | | OLD | | NEW | | OLD | | | | | | NEW | | OLD | |
| | FIT | UNFIT | FIT | UNFIT | FIT | UNFIT | FIT | UNFIT | FIT | UNFIT | FIT | UNFIT | FIT | UNFIT | FIT | UNFIT |
| 1 | A | B | C | D | | | | | | | | | | | | |
| 2 | A | B | A | B | C | D | C | D | | | | | | | | |
| 3 | A | F | B | F | | | | | | | | | | | | |
| 4 | A | F | B | F | C | F | D | F | | | | | | | | |
| 5 | A | B | H | H | | | | | | | | | | | | |
| 6 | A | B | H | H | C | D | H | H | | | | | | | | |
| 7 | A | B | B | B | | | | | | | | | | | | |
| 8 | A | B | B | B | C | D | D | D | | | | | | | | |

FIG.16

SETTING OF EXTERNAL STACKING UNITS

| | | | |
|---|---|---|---|
| MIXED | 10000 | 900000 | SHEETS |
| MIXED | 5000 | 900000 | SHEETS |
| | 2000 | 800000 | SHEETS |
| | 1000 | 900000 | SHEETS |

| | | |
|---|---|---|
| 10000 YEN NOTE | | SHEETS |
| 5000 YEN NOTE | | SHEETS |
| 2000 YEN NOTE | | SHEETS |
| 1000 YEN NOTE | | SHEETS |

| | | | |
|---|---|---|---|
| 10000 FIT OLD | 0 BUNDLES | 0 SHEETS | a |
| 10000 UNFIT OLD | 0 BUNDLES | 0 SHEETS | a |
| 5000 FIT OLD | 0 BUNDLES | 0 SHEETS | a |
| 5000 UNFIT OLD | 0 BUNDLES | 0 SHEETS | a |

| | |
|---|---|
| 10000 | 0 YEN |
| 5000 | 0 YEN |
| 2000 | 0 YEN |
| 1000 | 0 YEN |
| TOTAL | 0 YEN |

FIG.17

CURRENCY SORTER

FIELD OF THE INVENTION

The present invention relates to a currency sorter, and more particularly, to the one that serves to take in mixed currency deposited in sheets, discriminate, sort them out denominations, face values, or versions, put them into stacking units, and bundle a predetermined number of the notes.

BACKGROUND ART

In financial companies and organizations, a currency sorter is generally used to facilitate organizing and handling deposited currency notes. When a bunch of currency notes of normal and unfit conditions and of various face amounts together are deposited (normal notes are referred to as "fit notes" hereinafter while "unfit notes" means those which are significantly fatigue due to grime and breakage), such a currency sorter serves to sort the currency notes according to their respective denominations and fit/unfit conditions and then bundle typically a hundred of the notes, for example, with a tape.

A prior art sorter of the similar type can handle at most the currency notes of only three face values of 1,000 yen, 5,000 yen, and 10,000 yen, for instance, and the typical sorter is disclosed in Japanese Utility Model Registration No. 2597752 (Patent Document 1).

The Patent Document 1 describes a sorter that includes the external stacking units for the currency notes of the above-identified face values and two built-in stacking units for bundling.

The external stacking units have a fixed relation with denominations, and are simply allocated to the currency notes of the individual denominations. This means that it is impossible to sort out varied categories such as fit and unfit conditions, new and old versions, and the like to stack the notes of different categories discriminatively in the stacking units.

Since currency notes of 2,000-yen face value are introduced in the year 2001, it is required for the sorter to handle four types of currency notes including the new 2,000-yen notes in addition to the conventional three types of 1,000-yen, 5,000-yen, and 10,000-yen notes.

The revised version of the currency sorter to cope with such a requirement is proposed in Japanese Patent Laid-open Publication No. 2002-197509 (Patent Document 2), which have four stacking units for four of the denominations.

Furthermore, the currency design may be sometimes changed, and in such a case, the notes of the old version must be prevented from circulating any longer by collecting the notes of the old version and discriminating between the new and the old to sort out the versions. However, the prior art currency sorter can at most identify the currency notes with the new or old version.

Even with four stacking units for four of the denominations, when the sorter is working to bundle the four types of the currency notes, all of the four stacking units is loaded with the currency notes, and if only one of the stacking units is fully stuffed, a deposit and reception of the notes must be interrupted. The currency notes taken out from the stacking unit immediately before "full" in the stacking unit is detected are to be rejected even if they are fit and authenticated.

Thus, such an interruption degrades an operation efficiency as well as processing efficiency. In addition, till the notes filling the stacking unit are conveyed to undergo the bundling, incoming notes of the same denomination (or the same category) also causes an interruption, and the incoming notes are rejected.

Moreover, the currency notes taken in just before the detection of stacking unit full, which are rejected even if they are fit and authenticated, cause a rejected note stacking unit to contain the really rejected notes and the normal notes together. This necessitates all the notes in the trash unit to undergo the session of process twice, and this significantly degrades the processing efficiency.

The sorters in the prior art can bundle the currency notes discriminatively between the new and old versions but not according to additional categories and conditions, and some of such sorters have to make the notes pass through the same sequence of the processing steps till they are sorted as desired.

Furthermore, some other of the prior art sorters can sort out new and old versions and fit and unfit conditions in combination, but not for two different denominations at the same time. Thus, the sorter has to make the currency notes pass through the same sequence of the processing steps at least twice till they are sorted as desired.

In some real site of the practical use, it is greatly desired that the currency notes that should be withheld and those that are to be released (e.g., fit notes of the new version) should be discriminatively bunched and bundled. This is because, when the currency notes of the new version and those of the old version are stacked together, the notes of the old version and the unfit notes of the new version are to be equally prevented from circulating in the financial market.

Such really desired way of the sorting cannot be attained in the conventional fashion where the currency notes of the same denomination are bunched discriminatively according to the new and old versions and the fit and unfit conditions in combination.

SUMMARY OF THE INVENTION

The present invention is made to overcome the above-mentioned disadvantages in the prior art, and accordingly, it is an object of the present invention to provide a currency sorter that attains increased flexibility to process notes of as many as four denominations and that enables currency notes of old version to be efficiently withheld when a design of the currency is revised.

It is another object of the present invention to provide a currency sorter that can efficiently recover from the operation stuck due to a stacking unit(s) got stuffed.

According to one aspect of the present invention, there is provided a currency sorter comprising:

take-in means for taking currency notes in the sorter one by one;

discriminating means for discriminating the currency notes according to new and old versions, fit and unfit conditions, denominations and other categories;

a plurality of stacking units for stacking the currency notes of a predetermined category/categories designated to be bundled according to the discrimination results obtained by said discriminating means;

designating means for designating the category of the notes to be bundled and a mode of sorting the notes to leave unbundled; and control means for controlling allocation of currency notes discriminated by said discrimination means to said stacking units according to a designation by said designating means.

The currency sorter is provided with a plurality of built-in stacking units and two external stacking units, and a sorting scheme is specified so that currency notes to be bundled in a subsequent stage and those left in sheets are separately sent to the built-in stacking units and the external stacking units, respectively. Hence, the notes to be left in sheets without undergoing the bundling can be sorted out, and the succeeding handling becomes easier.

For each deal, setting means is used to determine how to allocate the built-in stacking units and the external stacking units to individual categories of the currency notes, and hence, an flexibility to sort the currency notes can be increased without compromising on more efficient processing.

Since the sorter has five or more stacking units to stack the currency notes to be bundled, the number of the stacking units are greater than that of the denominations of the currency that are at present circulating in Japan, and the extra stacking unit(s) are useful in that, when the currency is revised in design and then the currency notes of both new and old versions are passed in the financial market, varying the sorting norm to handle the currency notes of the old version as the unfit ones of the new version enables the currency notes of the same denomination to efficiently be sorted out according to only two categories, that is, (1) the fit notes of the new version laid in a stock of change and (2) the unfit notes of the new version and all the notes of the old version that are to be withheld to prevent from circulating in the market. The extra stacking unit(s), as many as a difference of four of the denominations of the currently circulating currency from the number of the stacking units provided in the sorter, also enables the currency notes of two of the denominations at a time to efficiently be sorted out in the similar manner to the above. In addition, if one of the stacking units becomes full, the fifth stacking unit can be substituted for the stuffed one, and this is useful to further enhance the processing efficiency.

According to another aspect of the present invention, there is provided a currency sorter comprising:

take-in means for taking currency notes in the sorter one by one;

discriminating means for discriminating the currency notes according to new and old versions, fit and unfit conditions, denominations and other categories;

a plurality of stacking units for stacking the currency notes of a predetermined category/categories designated to be bundled according to the discrimination results obtained by said discriminating means, the number of said stacking units being greater by one than the number of denominations;

bundling means for bundling currency notes of predetermined number;

designating means for designating the category/categories of the notes to be bundled and a mode of sorting the notes to leave unbundled; and control means for controlling allocation of currency notes discriminated by said discrimination means to one of said plurality of stacking units according to a designation by said designating means, and for controlling taking-in operation of said take-in means such that after one of the stacking units becomes completely full and the extra stacking unit is substituted to stack the notes of the same denomination, if the remaining stacking units are about to be full, said take-in means is switched from "continual feeding" to "intermittent feeding" to confirm denomination by said discriminating means and the substitution continues until new space generates in the extra stacking unit.

The currency sorter according to the present invention has the stacking units as many in number as one added to the number of denominations of the currency notes to be bundled, and when one of the stacking units becomes full during dumping the currency notes therein, the currency transfer is switched from the continual basis to the intermittent basis in case of no vacant extra stacking unit. As a consequence, there is no need of interrupting a deposit and receipt of the currency notes and rejecting all the currency notes, and this also enhances the processing efficiency.

BRIEF DESCRIPTION OF THE DRAWINGS

FIG. 3 shows the setting in a selectable denomination bundling mode where an old version note is treated as a normal note;

FIG. 4 shows the setting In a direct bundling mode where an old version note is treated as a normal note;

FIG. 5 shows the setting in an entry and batch mode where old version note is treated as a normal note;

FIG. 6 shows the setting in a selectable denomination bundling mode where an old version note is treated as a rejectable note;

FIG. 7 shows the setting in a direct bundling mode where an old version note is treated as a rejectable note;

FIG. 8 shows the setting in an entry and batch mode where an old version note is treated as a rejectable note;

FIG. 9 shows the setting in a direct selectable denomination bundling mode where an old version note is treated new unfit note;

FIG. 10 shows the setting in a direct bundling mode where an old version note is treated a new unfit note;

FIG. 11 shows the setting in an entry and batch mode where an old version note is treated as a new unfit note;

FIG. 16 is a diagram showing allocations of built-in and external stacking units to various categories of the currency notes such as facial values, new and old versions, and the like, under the various settings in the embodiment according to the present invention;

FIG. 17 illustrates a screen display of definite data as to the external stacking units;

DETAILED DESCRIPTION OF THE INVENTION

An embodiment of the present invention will now be described with reference to the accompanying drawings.

Figure 1:
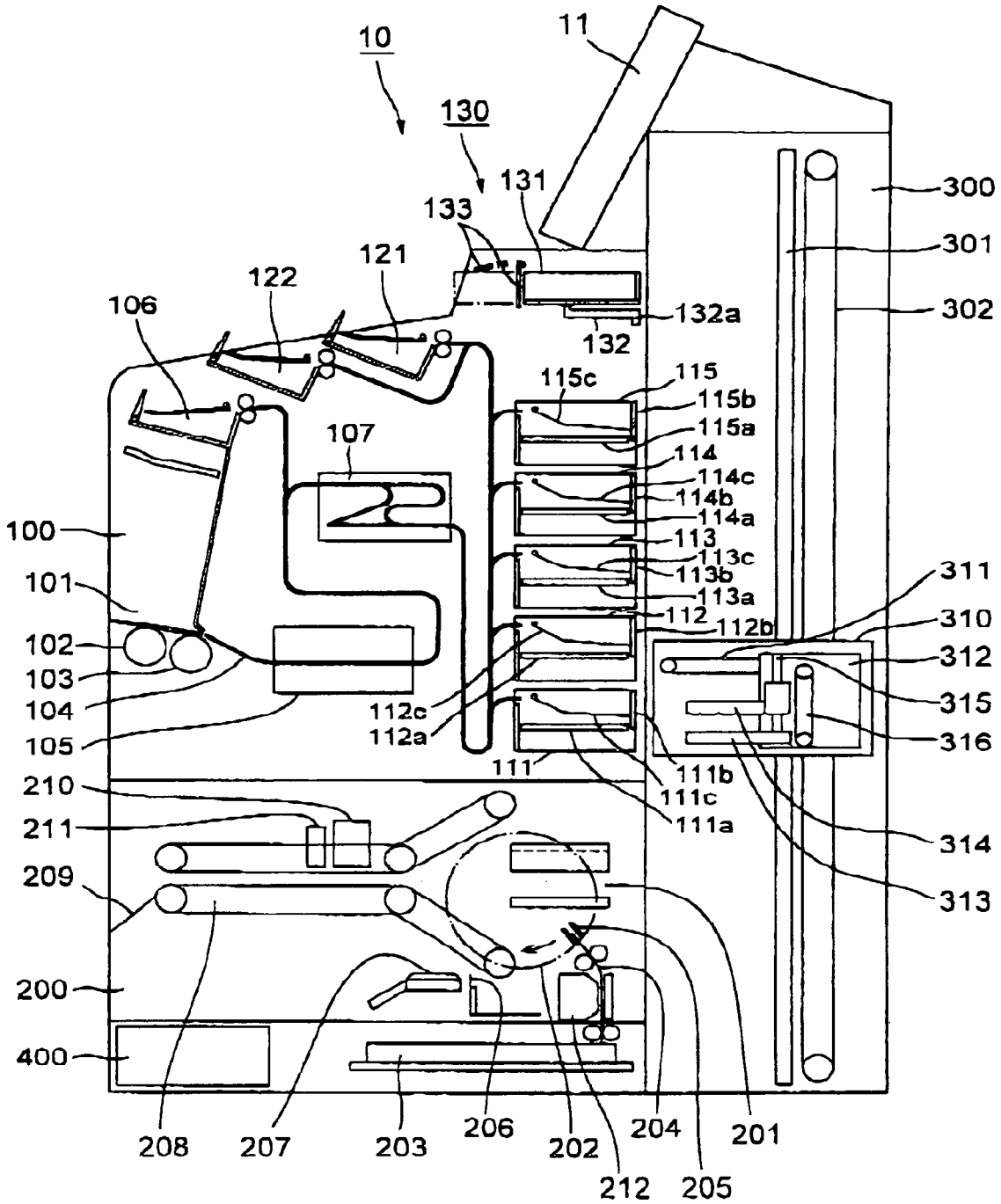
FIG. 1 is a vertical sectional view schematically showing an inner structure of an exemplary currency sorter in accordance with the present invention.

FIG. 1 is a vertical sectional view schematically showing an inner structure of an exemplary currency sorter in accordance with the present invention.

A currency sorter 10 has an operation display unit 11 at its top, a sorter/stacking unit 100 in its upper frontal area, a bundling unit 200 in its lower frontal area, and a conveyer unit 300 at its back.

<Sorter/Stacking Unit 100>

The sorter has a receiving slit 101 approximately at the center of the front to receive currency notes, and the deposited mixed notes of various denominations are taken in by rollers 102 and 103 to convey them along on a conveying route 104.

In the middle of the conveying route 104, a discrimination unit 105 is located to identify the currency notes with denominations, fit and unfit conditions, authenticated and counterfeit entities, and front and reverse orientations. The discrimination unit 105 herein is capable of discriminating new and old design versions of the currency notes of the same denomination.

The conveying route is branched ahead of the discrimination unit 105, and as a result of the discrimination by the discrimination unit 105, the notes identified with the unfit and the counterfeit are thrown as rejected sheets in a stacking unit 106. The authenticated notes recognized as in the fit condition further undergo inspections of their respective front or reverse orientations to be stacked head to tail into a orderly heap by a front-back reversing unit 107, and thereafter, they are sorted according to other requirements and then transferred to one of stacking units 111 to 115 for the later processing of bunching and bundling with a band.

The stacking units 111 to 115 have their respective stacking stages 111*a* to 115*a* that can be moved up and down by a lift means (not shown).

In FIG. 1, the stacking units 111 to 115 are ready to load. Walls extending over upper ⅔ dimension of the stacking units, which are denoted by alphanumerical reference signs 111*b* to 115*b*, have their respective lowest ends leveled with the stages 111*a* to 115*a*, and hence, the currency notes deposited in the stacking units bump against the walls 111*b* to 115*b* and temporarily settled therein. Weight plates 111*c* to 115*c* pivot depending upon an amount of the deposited notes and press them down so as to prevent the notes from flirting out over the walls. The stages 111*a* to 115*a* and the walls 111*b* to 115*b* have their respective slits that permit a conveyer hand as mentioned below to freely move through.

On the other hand, the remaining currency notes, which are left without undergoing the subsequent bundling process, are transferred to external stacking units 121 and 122.

These stacking units 111 to 115 and the external stacking units 121 and 122 can be used to discriminatively stack various types of currency notes in various manners by varying settings depending upon the categories such as denominations, fit and unfit conditions, new and old versions of the currency notes and combinations of them. Descriptions of the settings are omitted herein since they are simply of minor concerns of the present invention.

A money returning unit 130 is located under the operation display 11, and a fraction of a predetermined number of the currency notes left in the stacking units without undergoing the subsequent process of bundling are retrieved to return therein. The money returning unit 130 has a tray 131 with a contact lever 132 extending from its bottom, and a tip 132*a* of the contact lever is pushed from behind to let the tray 131 move forward, which allows a front shutter 133 to open so as to further stuck the tray forward as depicted by dashed-dot line, thereby enabling an operator to take out the fractional number of the currency notes. Further structures and functions of this part will be detailed later.

<Bundling Unit 200>

A bundling unit 200 located under the sorter/stacking unit 100 serves to wind a band around a bunch of currency notes after a predetermined number (e.g., a hundred) of them are sorted and stacked.

The bunch of the currency notes, when reaches one hundred in number in the stacking unit 111 to 115, are transferred through the conveyer unit 300 to a stack unit 201 where the currency notes are held by pressing up and down thereon.

A rotary mechanism 202 is provided to wind bundling tape in position around the press-held currency notes, and its rotary motion makes the bundling tape 204 hold the bundle of the notes tight while a bundling mechanism 205 pinches one end of the bundling tape released from a tape box 203. Thus, after winding the bundling tape up, the end of the tape is cut by a cutter and thermally bonded by a heater 207 to bundle the notes.

The bundled currency notes are transferred on a belt conveyer mechanism 208 and stacked down to a sorter outlet 209 in the course to which provided are a stamp 210 imprinting on the bundling tape a mark of a financial company that treated and processed the notes, and another stamp 211 imprinting on the bundling tape a mark indicative of unfit notes.

A run out mechanism of the bundling tape 204 is provided with a printer 212 printing a date of the bundling process, a time of the same, a serial number of the processing machine, processing data featured according to the present invention, an discrimination number of a person in charge, and the like.

The bundled currency notes may be sent to the sorter outlet as in this embodiment, and alternatively, as in an apparatus disclosed in Japanese Patent Preliminary Publication No. 2003-141606, the bundled currency notes may be put in stacking in a housing.

The conveyer unit 300 at the back of the sorter transports both the currency notes ready to be bundled in the following stage and the odd notes left in sheets, between the stacking units 111 to 115 and the bundling unit 200 or the money returning unit 130.

<Conveyer Unit 300>

The conveyer unit 300 is comprised of a guide shaft 301 vertically extended between lower and upper ends of the sorter, a lift unit 310 operatively engaged with the guide shaft 301 to move up and down, and a driving belt 302 used to move the lift unit 301 up and down.

The lift unit 310 has a block 312 that is operatively held on a belt mechanism 311 to move backward and forward, and the block 312 is provided with a fixed lower hand 313 and an upper hand 314 vertically movable along the shaft 315 by means of the belt 316. The hands 313 and 314 press up and down on the currency notes stacked and ready to be bundled or the currency notes left in sheets in the stacking units 111 to 115 and take them out therefrom to transfer to the bundling unit 200 and the odd money returning tray 131 of the money returning unit.

<Control Unit 400>

A control unit 400 is provided to control the total operation of the currency sorter as a whole. The control unit 400 has a microprocessor serving as the control means, and a communication means using communication line for connecting the microprocessor with a supercomputer such as the one introduced in the center of a financial company or organization. Such a communication means serves to send data on all the circumstances within the currency sorter one after another to the super computer.

In FIG. 1, the control unit 400 is depicted residing under the bundling unit 200 for convenience sake, but it can be placed in any spatially available part within the sorter, as a matter of the design, for example, behind the operation display unit 11.

In the currency sorter configured as stated above, the present invention provides an improved design of the stacking units for the currency notes ready to be bundled with the tape and the external stacking units for the notes to be left unbundled, which can be respectively allocated to individual categories of the currency notes according to their respective denominations, fit and unfit conditions, new and old versions, and so forth.

Figure 2:
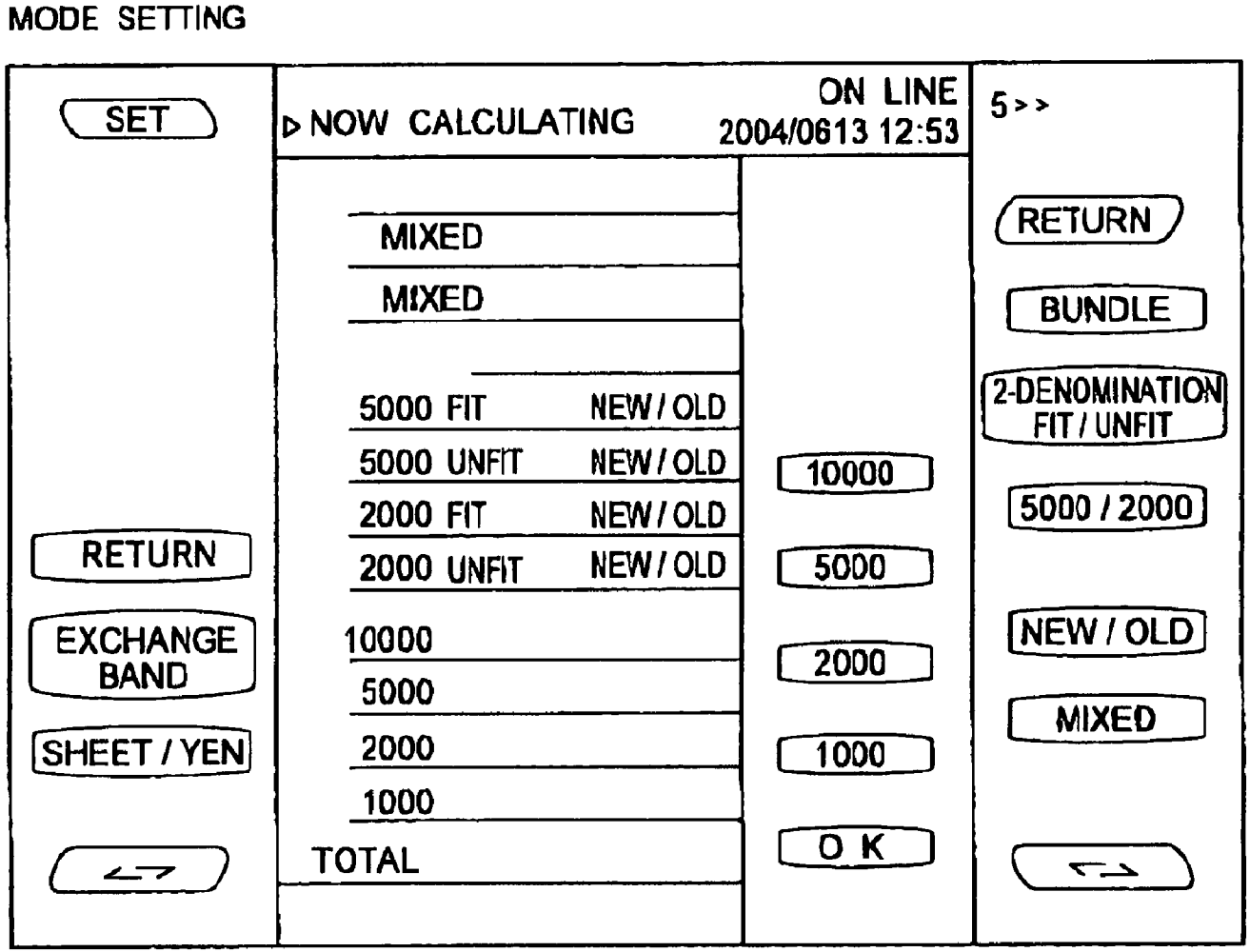
FIG. 2 illustrates a screen of the settings of various modes.

FIG. 2 shows an exemplary mode setting screen presented in the operation display, which is evoked as a result of touching the uppermost setting button in the leftmost column. The screen is configured in a touch panel that presents guidance to various manipulations of the sorter only by letting the operator touch some part on the screen.

There are various setting buttons in the leftmost, rightmost, and second rightmost columns in the screen, and the operator touches the buttons to select the denominations, conditions, and versions of the currency notes to be stacked in the stacking units and the external stacking units.

The second leftmost column gives the descriptions of the settings selected for each stacking unit and values of the money treated. The uppermost and second uppermost rows show the settings in relation to the external stacking units 121 and 122, and the next four rows show the settings relative to the stacking units 111 to 114. The stacking unit 115 is of a supplemental use in case that any of the stacking units 111 to 114 becomes full.

FIG. 2 shows an example of the mixed notes stacked in two of the external stacking units 121 and 122, and the fit 5,000-yen notes of both the new and old versions, the unfit 5,000-yen notes of both the versions, the fit 2,000-yen notes of both the versions, and the unfit 2,000-yen notes of both the versions stacked in four of the stacking units 111 to 114, respectively. The terms "mixed" and "of both the new and old versions" will be explained later.

The remaining part of the screen below these setting descriptions gives the subtotals for the notes of the individual denominations and the total for the all.

FIGS. 3 to 11 are diagrams showing the settings of various processes selectable on the currency sorter according to the present invention.

Figure 12:
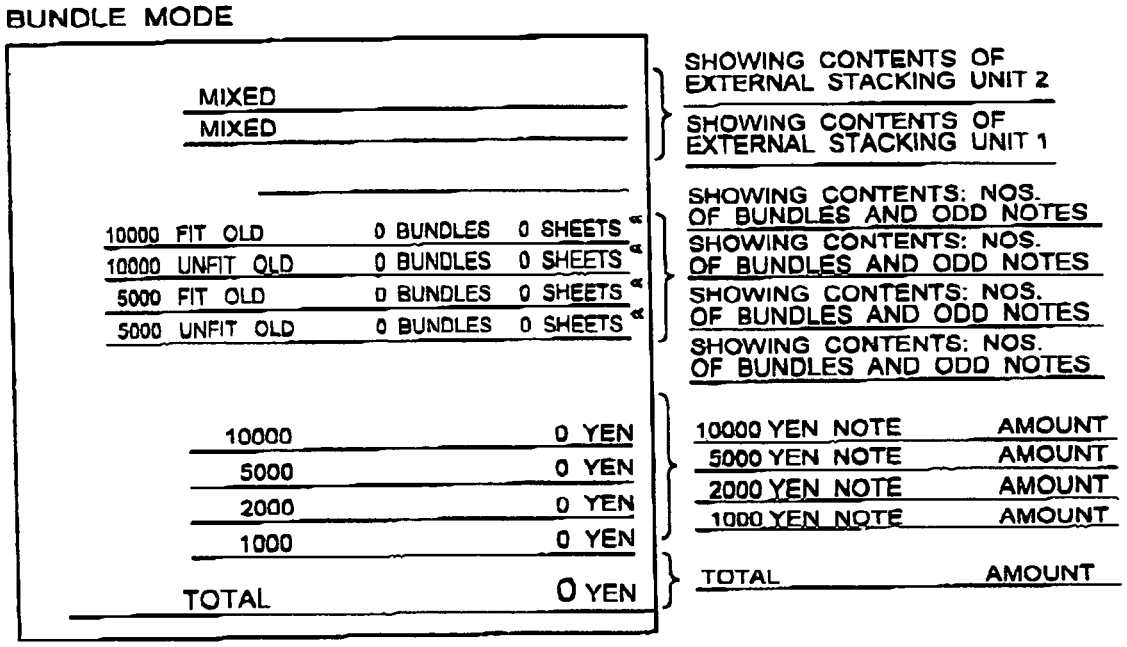
FIG. 12 shows an example of a screen display presented on the operation display unit while the sorting is being conducted in the bundling mode.
Figure 13:
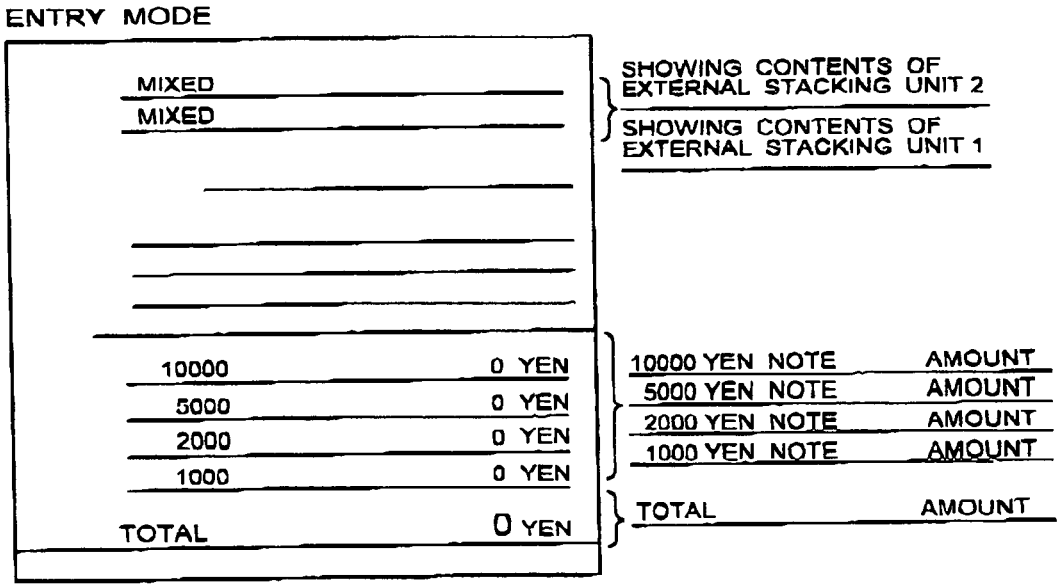
FIG. 13 shows an example of a screen display presented on the operation display unit while the sorting is being conducted in the entry mode.
Figure 14:
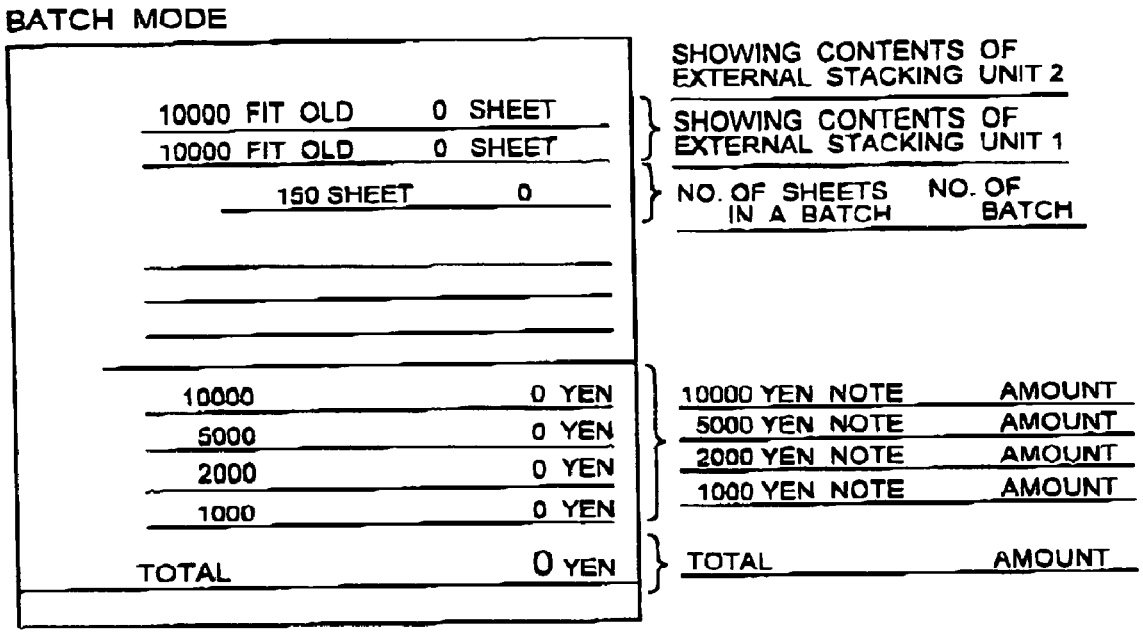
FIG. 14 shows an example of a screen display presented on the operation display unit while the sorting is being conducted in the batch mode.

FIGS. 12 to 14 are diagrams illustrating examples of a screen display providing the settings in processing and track record.

A case depicted individually in FIGS. 3 to 5 is an indiscriminative handling of the notes of the old version from those of the new version, regarding them as notes of normal version: FIG. 3 shows a case where the denominations of the currency notes to be bundled with the tape are selected, FIG. 4 shows a case where a combination of the denominations of the currency notes to be bundled are directly selected, and FIG. 5 shows a case where the currency notes are not bunched and bundled.

In FIG. 3, an operation in a bundling mode proceeds by selecting the denominations of the currency notes to be bundled. In this mode, the bundling mode is an initial value (default value).

There are five of the stacking units in this embodiment, and therefore, these stacking units are respectively allocated to individual denominations of 10,000, 5,000, 2,000, and 1,000. Although the default value is a designation of all the four denominations, it is not necessarily desired to sort and bundle the currency notes of all the denominations, and there is a choice of one, two or three of all the four denominations, as desired. Allowing for an actual amount passed in the financial market, the initial value can vary among 10,000 in selecting the single denomination, 10,000 and 1,000 in selecting the double denominations, and 10,000, 5,000 and 1,000 in selecting the triple denominations, and this also can be changed to any single denomination or any combination of the denominations as desired.

For all the denominations and the combinations thereof, an additional selection can be made in bunching the currency notes to be bundled, according to the conditions of the notes, namely, fit or unfit. More specific discrimination is made among the fit notes of good condition, the unfit notes of poor condition, the mixed fit notes, and the mixed unfit notes so that one of them can be selected, although the initial value is the fit notes. The "mixed fit notes" are a batch of the currency notes that are stacked without discrimination of the fit notes from the unfit notes and then bundled where the unfit notes in the bundle are exceptionally regarded as the fit notes. The "mixed unfit notes" are a batch of the currency notes under the mixed condition of fit and unfit, and after bundled, they have a mark indicating "unfit" stamped on the bundling tape.

There is still another choice between the new and old versions of the currency. When the currency is changed in design, the new and old conditions can be designated for only the notes of the denomination(s) of which design has been renewed, or rather, the conditions may be designated without discrimination of the old version from the new version. The initial value is the new version.

As has been described, since the stacking units are allocated to the individual categories according to the denominations, conditions, and versions of the notes, and the notes which do not fall in the categories are regarded as being not ready to be bundled and transferred to the external stacking units instead of the built-in stacking units.

The currency notes sent to the external stacking units can include some other categories designated by the settings. In this embodiment, there are two of the external stacking units, and therefore, there is a choice among discriminating between the fit and unfit conditions, discriminating between the new and old versions, and dumping the mixed without such discrimination.

In dumping the fit and unfit notes separately, for example, the external stacking unit 121 stacks the fit notes not falling in the categories designated as ready to be bundled with the tape while the external stacking unit 122 stacks the unfit notes or the mixed notes out of the above designation. Such a discriminative stacking enables the unfit currency notes to be eliminated so that only the fit notes are to be treated in the succeeding steps, and this is advantageous to enhance the operation efficiency.

In dumping the notes of the new and old versions separately, for instance, the external stacking unit 121 stacks the new notes out of the designation as ready to be bundled with the tape while the external stacking unit 122 stacks the old notes out of the same designation. Such a discriminative stacking ensures to eliminate the currency notes of the old version so as to be withheld or not to be passed In the financial market.

Under the setting of a choice of the mixed notes, when the external stacking unit 121 becomes stuffed (typically with two hundreds of the notes), the external stacking unit 122 is supplementally used. While the notes are being stacked into the external stacking unit 122, evacuating the external stacking unit 121 makes it ready for supplemental use instead of the stacking unit 122 when it becomes full later. The currency notes stacked in and evacuated from the external stacking unit have their respective categories checked and presented with definite data on the display unit, and the data are preferably sent to the super computer via the communication means of the control unit 400.

FIG. 12 shoes an example of a screen display presented on the operation display unit while the sorting is being conducted in the bundling mode.

The uppermost row and the second uppermost row show the categories of the currency notes stacked in the external stacking units. In this example, the currency notes not falling in the categories designated as ready to be bundled with the tape are deposited without discrimination between the fit and unfit conditions and between the new and old versions.

The following four rows show the settings of four of the built-in stacking units, as well as the number of bundles that have been bundled, and the number of sheets left as the odd currency notes without being bundled. In this case, the currency notes stacked in these stacking units are of the comunited categories of 10,000-yen fit notes of the old version, 10,000-yen unfit notes of the old version, 5,000-yen fit notes of the old versions, and 5,000-yen unfit notes of the old version.

The fourth lowermost row to the lowermost row show the subtotals of the notes of individual four denominations taken in and processed, and the total.

FIG. 4 is a diagram showing a case where the currency notes of the old version are treated as notes of normal version, and a variety of manners of the bundling are directly designated.

There are five manners designated in this embodiment, including "one denomination/fit and unfit" where only one denomination out of the four of 10,000, 5,000, 2,000 and 1,000 (initial value is 10,000) is selected to sort the notes of that denomination according to the fit and unfit conditions and dump them separately into two of the stacking units; "two denominations/fit and unfit" where two denominations out of the four (initial values are 10,000 and 1,000) are selected to sort the notes of those denominations according to the fit and unfit conditions and dump them separately into four of the stacking units; "one denomination/new and old" where only one denomination out of the three of 10,000, 5,000, and 1,000 (initial value is 10,000) is selected to sort the notes of that denomination according to the new and old versions and dump them separately into two of the stacking units; "two denominations/new and old (A)" where two denominations out of the three (initial values are 10,000 and 1,000) are selected to sort the notes of those denominations according to the new and old versions and dump them separately into four of the stacking units; and "two denominations/new and old (B)". With the "two denominations/new and old (B)", two denominations out of the four (initial values are 10,000 and 1,000) are selected to sort the notes of those denominations according to the new, old, and normal versions (initial value is new version). Unlike the "one denomination/new and old" and "two denominations/new and old", there is no choice among "fit", "unfit", "mixed fit", and "mixed unfit".

In such a direct designation, at the stacking of the currency notes into the external stacking unit(s), one out of "all mixed", "discriminating fit from unfit", and "discriminating new from old" can be designated FIG. 5 depicts a case where the currency notes of the old version are treated as normal version, and processed without bundling.

"Entry mode" means a manner in which the currency notes of mixed category, when deposited in a dumping slit, are sorted out according to the desired category to dump in the external stacking units, being stacked head to tail into a orderly heap For this mode, it is determined in advance what two of the external stacking units are used for, and there is no choice regarding the external stacking units, or rather, no response is given by pressing a setting button. Unidentified notes are transferred to the rejected note stacking unit 106. The "entry mode" deals with the following four processing categories.

The initial (default) value of the processing categories is "discriminative" where one out of the four denominations of 10,000, 5,000, 2,000 and 1,000 (initial value is 10,000) is selected to sort the notes according to the new, old, normal old versions (initial value is new), and the fit notes of the selected version is stacked in the external stacking unit 121 while both the unfit notes of the selected denomination and the notes of the remaining versions are transferred to the external stacking unit 122. Thus, as is apparent so far, there is no choice of designating the fit and unfit conditions.

In the remaining processing categories of the "indiscriminative", "fit and unfit", and "new and old", there is no choice of selecting the denomination, and the currency notes of all the denominations are processed mixed.

First, in the "indiscriminative" processing, only the currency notes of the designated version of new, old, or normal are conveyed without discriminating between the fit and unfit conditions and then deposited in the external stacking unit 121. When the external stacking unit 121 becomes full, the external stacking unit 122 is substituted for the stacking unit 121. The currency notes of the remaining versions are transferred to the rejected note stacking unit 106.

In the "fit and unfit" processing, the fit notes of the designated version are deposited in the external stacking unit 121 while the unfit notes of the same version are stacked in the external stacking unit 122. The notes of the remaining versions are transferred to the rejected note stacking unit 106.

In the "new and old" processing, there is no choice of the denominations, conditions, and versions of the currency notes, and the notes of the new version is deposited in the external stacking unit 121 while the notes of the old version are deposited in the external stacking unit 122.

In this embodiment, as a matter of convenience of the teaching, there is no choice of the denominations in the "fit and unfit" processing and "new and old" processing, but the denominations may be designated. In the latter case, the currency notes of the denominations not designated are transferred to the rejected note stacking unit 106.

FIG. 13 is a diagram showing an example of a screen display presented on the operation display unit when the sorting is being conducted in the entry mode.

The uppermost row and the second uppermost row show the categories of the currency notes stacked in the two external stacking units. In this example, the currency notes of all the denominations are deposited without discrimination between the fit and unfit conditions and between the new and old versions.

The four built-in stacking units are not used, no settings are displayed related to the stacking units, and the lowermost row shows the subtotals of the notes taken in and processed, and the total.

Next, the "batch processing mode" is a manner in which the currency notes, when deposited In a dumping slit, are counted, and a predetermined number of them are stacked in the external stacking units, being stacked head to tail into a orderly heap.

A determination of the number of sheets is entered from ten keys to fall in a capacity range of the external stacking units (as many as 200 in number: the initial value is 150), and there is a choice among "automatic", 10,000, 5,000, 2,000, 1,000 (initial value is "automatic"). Although the notes are normally discriminated between the fit and unfit conditions; if not, there is a choice between fit and unfit, and there is a further choice among the new, old, face-new versions (initial value is new). The unfit notes of the selected denomination and the notes of the remaining denominations are transferred to the rejected note stacking unit 106.

The denomination "automatic" is a manner in which, when the currency notes and put in the dumping slit and conveyed, the one incoming first has its denomination checked to send all the notes of that denomination to the external stacking units. For example, the note incoming first is 10,000-yen bill, the denomination of 10,000 is automatically designated for the succeeding sorting.

FIG. 14 illustrates an example of a screen display presented on the operation display unit when the sorting is being conducted in the batch mode.

The uppermost row and the second uppermost row show the categories of the currency notes stacked in the two external stacking units. In this example, the fit notes of the denomination of 10,000 yen are designated. Under the descriptions of the designated categories, a space is provided to enter the number of sheets treated through batch processing, and herein, 150 is given in advance. The batch processing can be repeated as frequently as desired, and the number of times of conducting the batch processing can be designated.

The four built-in stacking units are not used, no settings are displayed related to the stacking units, and the lowermost row shows the subtotals of the notes taken in and processed, and the total.

FIGS. 6 to 8 illustrate various fashions in which the currency notes of the old version are treated as rejected notes. All the drawings are counterparts to FIGS. 3 to 5, respectively, and since their contents are similar, only differences between them will be described below.

First, in selecting the dominations as in FIG. 6, a provision that the notes of the old version must be regarded as rejected notes inevitably exclude any choice but the new version. The remaining part is similar to that set forth in conjunction with FIG. 3.

In selecting the sorting categories through the direct bundling mode as in FIG. 7, since it is presupposed that all the notes of the old version should be treated as rejected notes, there is no choice of the processing categories of the "one denomination/new and old" and the "two denomination/new and old", and when the "two denomination/fit and unfit (B)" is designated, there is no choice but the new version.

Figure 15:
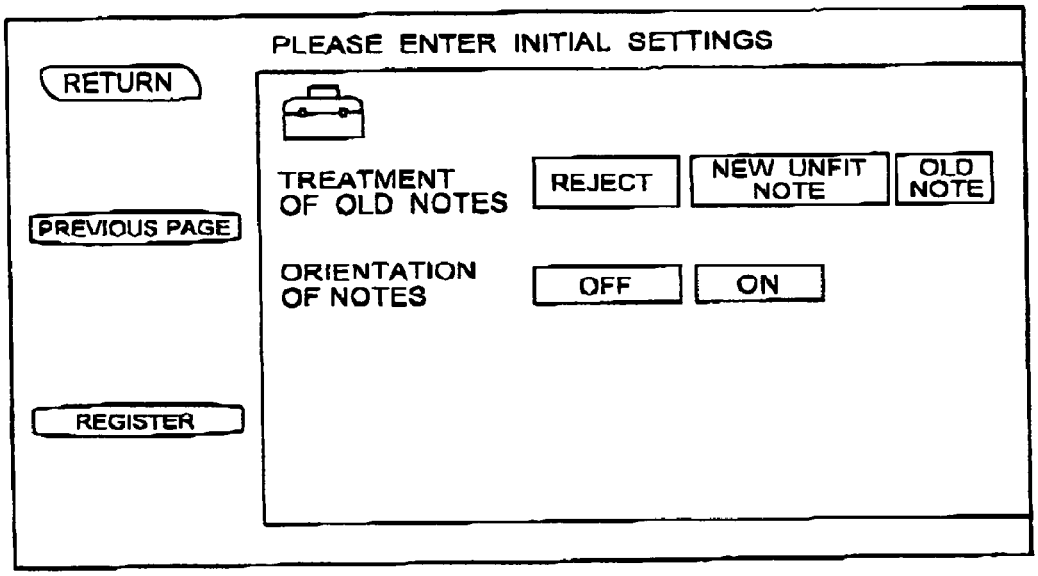
FIG. 15 illustrates a setting screen In treating the currency notes of the old version as unfit notes of the new version.

In a setting screen in FIG. 15, there is a choice of turning on and off of a "fit-side-up" orientation. The "fit-side-up" orientation means a manner in which a bundle of currency notes, when stacked head to tail into an orderly heap, the upsides of the notes are oriented upward while the "wrong-side up" can be defined as an upside down orientation, and the terms "turning on a fit-side-up mode" is a fashion where all the currency notes deposited to bind have all or part of them inverted to be in the "fit-side up" orientation.

Specifically, in the case of bunching and bundling 10,000 bills, turning on the fit-side-up mode causes the discrimination unit 105 to check front or reverse orientations of the currency notes deposited in the dumping slit 101, and after that, the front-back reversing unit 107 reverses all or part of the currency notes so as to stack them head to tail. The fit-side-up notes are stacked in the stacking units 111 to 115 and bundled while the fit-side-down notes are expelled to the external stackers 121, 122. The notes evacuated in this way are stacked head to tail in an orderly heap, and therefore, if deposited in the dumping slit again, they can be re-stacked in the fit-side-up orientation and get ready to bind.

Turning off the fit-side-up mode results in the currency notes being put in a disorganized heap where the "fit-side-up and "fit-side-down" notes intermingle with one another, and then bundled with a tape.

FIGS. 9 to 11 illustrate various modes in which all the notes of the old version are treated as unfit notes of the new version.

In some real site of the practical use, it is greatly desired that the currency notes that should be withheld and those that are to be released (e.g., fit notes of the new version) should be discriminatively bunched and sealed. When the currency notes of the new version and those of the old version are stacked together, the notes of the old version and the unfit notes of the new version are to be equally prevented from circulating in the financial market.

In order to handle all the notes of the old version as unfit notes of the new version, the notes of the old version can be designated as unfit notes of normal version on the setting screen as shown in FIG. 15. Changing the settings in this way, the notes identified with the old version in the discrimination unit 105 are treated as the unfit notes of the new version regardless of their real fit and unfit conditions.

Since FIGS. 9 to 11 are also counterparts to FIGS. 3 to 5, respectively, and since their contents are similar, only differences between them will be described below.

First, in selecting the denominations as in FIG. 9, a precondition that the notes of the old version must be regarded as unfit notes of the new version inevitably exclude any choice other than the normal version. The remaining part is similar to that set forth in conjunction with FIG. 3.

In selecting the sorting categories through the direct bundling mode as in FIG. 9, since It is presupposed that all the notes of the old version should be treated as unfit notes of the new version, there is no choice of the processing categories of the "one denomination/new and old" and the "two denominations/new and old", and when the "four denominations" is designated, there is no choice but the new version.

In the "two denominations/fit and unfit" mode, the notes of two of the four denominations such as 10,000 yen and 5,000 yen are sorted and stacked in bundles of the fit notes of the new version and those of the unfit notes of the new version along with all the notes of the old version so as to bind those bundles separately, and hence, the processing efficiency can be maximized.

In a manner preset as in FIG. 11 where none of the deposited currency notes are bunched and bundled, there is no choice between the new and old versions because the sorting according to the new and old versions would not be conducted in the dumping mode, there is no choice but the normal version.

Although a variety of settings have been described so far, several typified cases will be given below so as to detail how the stacking units are to be used.

FIG. 16 illustrates allocations of the built-in and external stacking units to various categories of the currency notes such as facial values, new and old versions, and the like, under the various settings to sort two denominations of 10,000-yen and 5,000-yen bills in the embodiment according to the present invention where there are five of the built-in stacking units and two of the external stacking units. In FIG. 16, the stacking units 111 to 115 are denoted by alphabetical letters A to E, respectively, the external stacking units 121 and 122 are denoted by F and G, and the rejected note stacking unit 106 is denoted by H.

Case study provided herein: A first case is the "one denomination/fit and unfit" processing with the face value of 10,000 yen designated to sort the fit and unfit notes of that denomination according to the new and old versions where all the notes of the old version are treated as notes of the new version, regarded as normal version; a second case is the "two denominations/fit and unfit" processing with the face values of 10,000 yen and 5,000 yen designated to sort the fit and unfit notes of those denominations according to the new and old versions where all the notes of the old version are treated similarly as the new version; a third case is the "one denomination/new and old" processing with the face value of 10,000 yen designated to sort the fit notes of that denomination according to the new and old versions where all the notes of the old version are treated as the new version; a fourth case is the "two denominations/new and old" processing with the face values of 10,000 yen and 5,000 yen designated to sort the fit notes of those denominations according to the new and old versions where all the notes of the old version are treated as the new version; a fifth case is the one/denomination/fit and unfit" processing where all the notes of the old version are treated as rejected notes; a sixth case is the "two denominations/fit and unfit" where all the notes of the old version are treated as rejected notes; a seventh case is the "one denomination/fit and unfit" processing where all the notes of the old version are treated as unfit notes of the new version; an eighth case is the "two denominations/fit and unfit" processing where the notes of the old version are treated as unfit notes of the new version; and a ninth case is the dumping of the currency notes into the stacking units under the special settings where the stacking units denoted by alphabetical letters A to E are allocated to fit notes of the new version of 10,000-yen bill, unfit notes of the same, fit notes of the old version of 10,000-yen bill, unfit notes of the same, and fit notes of the new version of 5,000-yen bill, respectively, while the remaining stacking units denoted by F and G are allocated to unfit notes of the new version of 5,000-yen bill and notes of the old version of 5,000-yen bill regarded as the new version.

The currency notes of other denominations, conditions, and versions are stacked in the external stacking units 121 and 122 and the rejected note stacking unit 106 through some required settings.

As has been described, in this embodiment of the present invention, the currency notes can be deposited in the four built-in stacking units and the two external stacking units discriminatively according to the categories of the notes designated by various settings, and hence, the currency notes can be bunched and bundled as desired while the notes of other denominations, conditions, and versions out of the designation as having to bind can be sorted in the optimized manner for each deal, which makes the succeeding handling easier In the above-mentioned embodiment, without the settings to allocate the external stacking units 121 and 122 to the designated categories of the notes, the notes are first stacked in the external stacking unit 121, and after it becomes full, the other external stacking unit 122 are substituted, which has been described above. In such a situation, evacuating the external stacking unit 121 during loading the external stacking unit 122 with the notes, the empty stacking unit 121 gets ready to be loaded with the notes again.

In the prior art, as the currency notes are evacuated from the external stacking units, no indication of definite data is given in the display unit to let the operator confirm the number of the notes removed from the stacking units.

Thus, in this embodiment, the display unit provides the definite data on particulars of the evacuated notes from the external stacking units.

FIG. 17 depicts the display screen providing the determinate data, and the display unit gives indications of the number of sheets for each of the denominations of the currency notes taken out of the stacking units. This display contains only data of greater concern that are derived from the processing in the bundling mode under the settings of dumping the mixed notes in the external stacking units. The indication of the data is effected in simultaneous with the evacuation of the stuffed external stacking unit during which the processing units are in the stand-by status. Thus, the evacuation of the external stacking unit that is not full is not followed by the indication of the determinate data.

The determinate data are transmitted to a supercomputer introduced in the center of a company or organization, through communication line or wireless means, and stacked in the supercomputer.

The display unit provides clear indications of the number of the evacuated currency notes from the individual stacking units, and this facilitates confirmation of the particular numbers as definite data from the evacuation of the stacking units.

Especially, incremented numbers on the display unit lets the operator know if the stacking unit is evacuated when it is full, and an excessive frustration in handling the sorter can be relieved.

Figure 18:
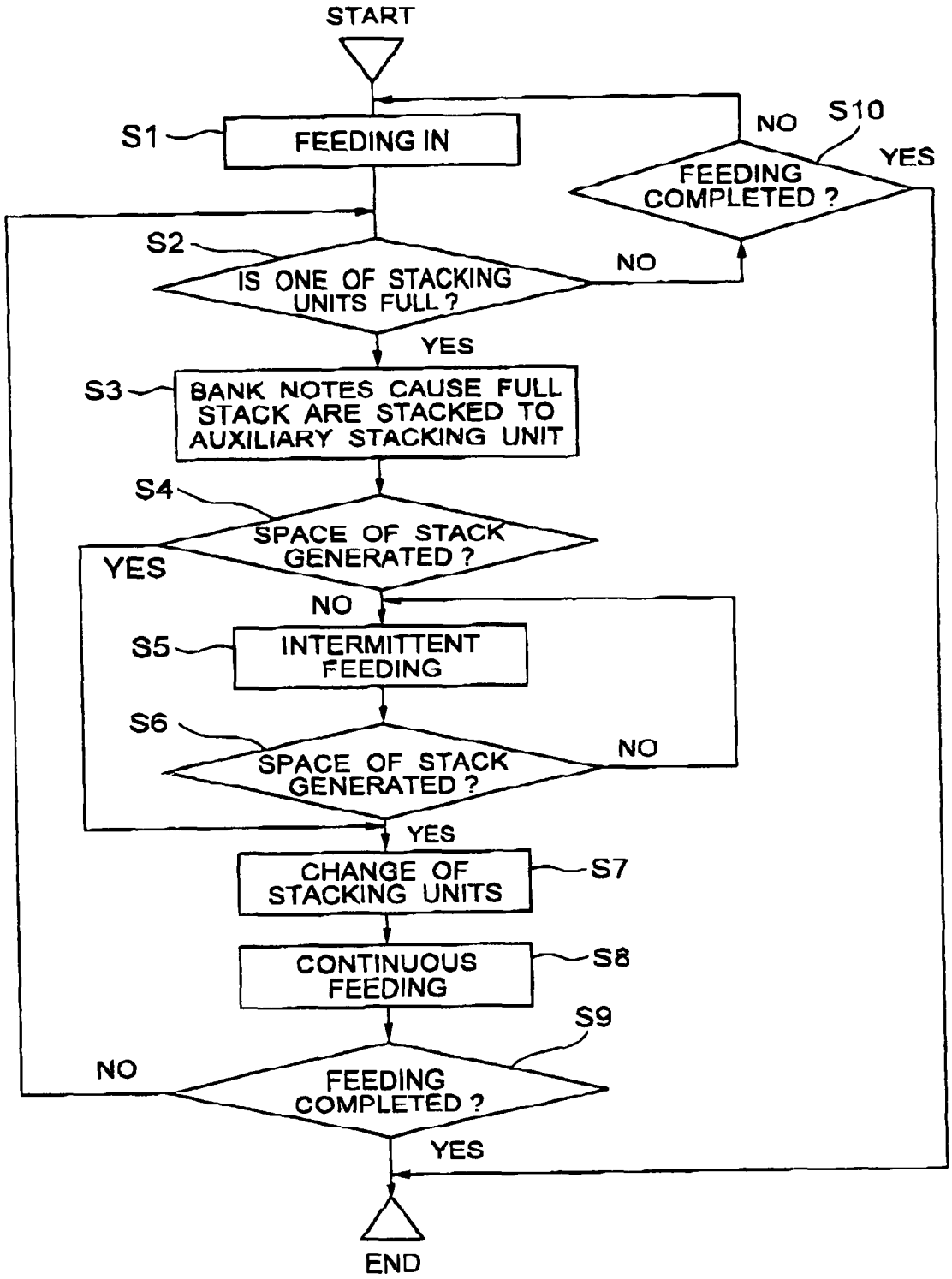
FIG. 18 is a flow chart illustrating a special control effected when a stacking unit gets full in the currency sorter according to the present invention.

FIG. 18 is a flow chart illustrating a control procedure in the case of the completely stuffed stacking unit, which is a unique part of the operation of the present invention.

Such control is preprogrammed, assuming that because currency notes to sort and bind are divided in four categories which the five stacking units are respectively allocated to, there still is the extra stacking unit.

The deposited currency notes are taken In (Step S1), and after undergoing the discrimination step, they are sorted according to the categories and put into four stacking units. Unless any of the stacking units is full (Step S2), the program will proceed with the processing till all the deposited notes have been fed in (Step S10). In this case, the taking-in of the currency notes is continually conducted.

If any of the stacking units becomes full (Step S2), the currency notes of the same category (categories) as those filling the stacking unit are stacked in the extra stacking unit (Step S3). A counter provided in each of the stacking units measures if the stacking unit is completely full or if it is about to be (detailed later).

When, any of the stacking units having become full, the substituted extra stacking unit is being loaded with the currency notes and still none of the stacking Units is vacant (Step S4), the taking-in of the notes turns to be intermittent (Step S5). The intermittent taking-in, unlike the continual taking-in, is sending the currency notes not simply in succession but in a fashion of considerably degraded operation speed despite the continual operation where after the first one of the deposited notes is sent to the discrimination unit to check its denomination, fit or unfit condition, new or old version, and the like, the succeeding notes are fed in. Thus, the intermittent taking-in of the notes is continued unless any of the stacking units is evacuated (Step S6).

As the currency notes filling the stacking unit are evacuated and then transferred to the bundling, the current settings are changed so that the evacuated stacking unit is ready to serve as another extra stacking unit (Step S7).

This quickens the taking-in of the notes, and thus, a transit from the intermittent taking-in to the continual taking-in can be effected (Step S8).

It is confirmed if the taking-in of the notes has been completed (Step S9), and if so, the entire operation is stopped. If not, the control operation in Step S2 is repeated.

The definition of the state of being about to be full can be made as desired, and the currency notes almost filling the stacking unit may range from 97 to 99 in number, with a supporting idea that typically, the stacking unit is completely stuffed with a hundred of the currency notes.

The counter is incremented either when the single currency note is deposited in the stacking unit or when the category check of the note in the discrimination unit results in the stacking unit being allocated.

When a preset value is predetermined as 99, and the current counter value reaches 98, it is greatly suspected that the counter is incremented to 99 when the single note is fed in. Also, allowing for such proneness, the control is preprogrammed.

When one of the stacking unit has been full, and another stacking unit that was about to be full has turned to be completely full, none of the stacking units is available to receive the notes already fed in, and only when such flood with the notes occurs, the entire operation is interrupted.

Employing the control preprogrammed as mentioned above, the feeding speed is dropped although the taking-in operation is not interrupted, and it is more likely to enhance an availability of the evacuated stacking unit, which brings about a reduced frequency of rejection of the normal currency notes and interruption of the machine operation. In this way, the processing efficiency is raised.

Figure 19A:
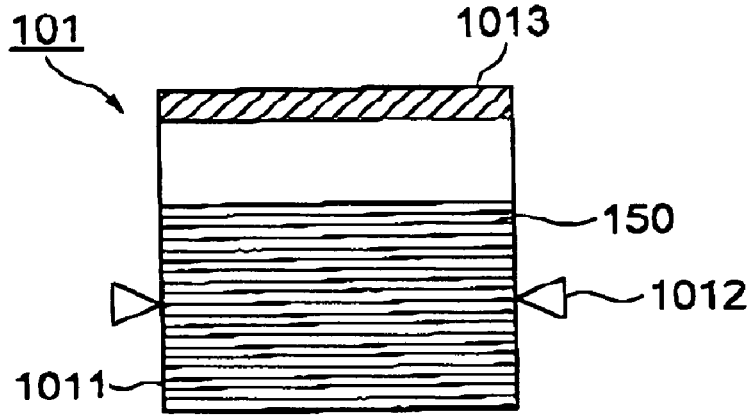
FIGS. 19A, 19B and 19C are schematic frontal views illustrating improvements of a dumping slit of the sorter.
Figure 19B:
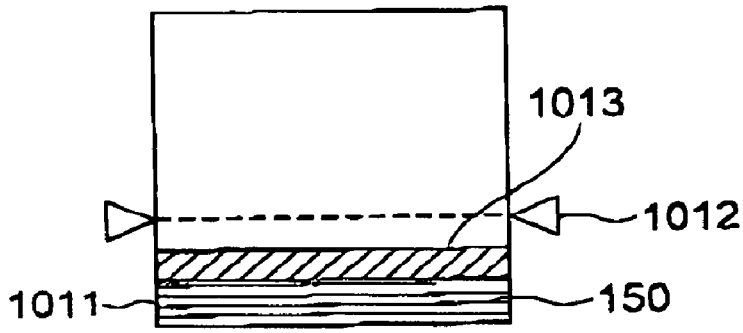
Figure 19C:
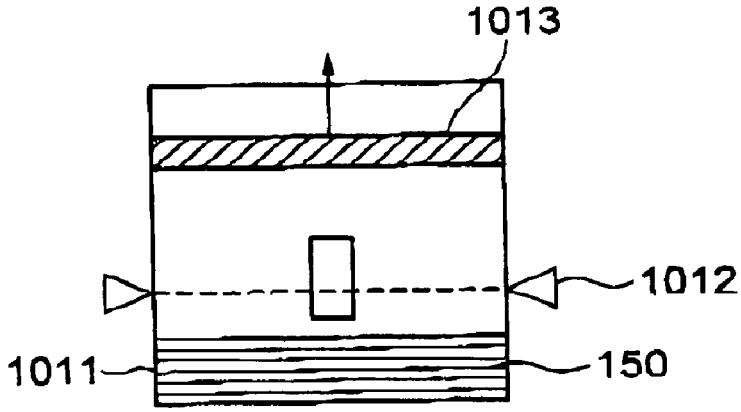

FIGS. 19A, 19B, and 19C are schematic frontal views illustrating improvements of the dumping slit 101, especially observed facing toward the same. The dumpling slit is an open box defining a cup 1011 in which currency notes 150 are laid, and a sheet weight 1013 is located above the cup so as to move up and down in the open box.

The sheet weight 1013 continues to press down on the bank notes in sheets from fit after the bank notes and deposited till all the notes are fed in the sorter body, and pushing a button causes the sheet weight to lift up.

With such a configuration, however, the sheet weight blocks additional bank notes from being put in. In general, when the currency notes are deposited in a moderate heap in the cup, a weight of the notes themselves tends to help them to shoot in one sheet after another without malfunction. When a pile of bank notes are laid in the cup 1011, however, pressing force by the sheet weight produces an excessive load onto the bank notes, and this sometimes damages the bank notes.

Thus, in this embodiment of the present invention, sensors are provided in a wall surrounding the cup 1011 to detect the top of the heap of the bank notes reach the lower critical level at and below which malfunction in feeding the notes in is prone to occur. The sheet weight works only when the top of the bank notes is lower than the critical level.

The sensors typically used have a light-emitting element in communication with a photo-detector. The bank notes, piled up to a certain level between the light emitting element and the photo-detector as shown in FIG. 9A, shields light emitted from the light emitting element, and hence, the sheet weight recedes high above the bank notes. With the sheet weight held in this position, it is easy to lay additional bank notes on the existing notes, and the sheet weight does not apply load excessively onto the bank notes.

As the bank notes progressively shoot in the sorter, and the top of the bank notes lowers beyond the position of the sensors, the sheet weight 1013 comes and press down on the bank notes, and thus, the bank notes can be stably fed in. The sheet weight 1013, when detected by the sensors in the course of coming down, are forced to recede, and in order to prevent this, the detection by the sensors is interrupted for two seconds.

If malfunction occurs with the sheet weight receding high above the notes, the sheet weight comes down in response to a command of "retry". This puts the bank notes strait in the cup to avoid the malfunction in feeding in the notes as much as possible. Thus, such malfunction no longer cause an inadvertent interruption of the operation, as well.

As shown in FIG. 19C, the sensors featured as in the above, when shielded from each other with an intervening opaque object, function to make the sheet weight lift up, and additional bank notes can be laid. In this way, the sensors work as a switch turned on to activate the sheet weight.

The bank notes, being superposed on the existing notes, inevitably shield the sensors from each other. The sheet weight is raised in response to this, and the additional bank notes are put in position while the sensors are not on the watch. In this way, the additional bank notes are deposited by one hand, and the operability is enhanced.

Also, in the embodiment of the present invention, since there are five of the stacking units that is greater in number than the denominations of the currency, not only the currency notes of all the denominations can be efficiently processed at the same time, but also allocating four of the five stacking units to various categories of the currency notes permits the notes of two of the denominations to be simultaneously sorted out according to the categories.

When one of the four stacking units to a certain denomination (or a certain version or condition of the notes) becomes full while all the remaining stacking units are in use, the fifth extra stacking unit can be substituted to stack the notes of the denomination already fed in the sorter. In this way, a rejection of normal notes and an interruption of the operation can be avoided, and the processing efficiency can be enhanced.

Handling the notes of old version as unfit notes of new version, simply designating to sort out fit and unfit conditions of the currency notes permits the notes of the old version to be bunched and bundled, and in this way, the notes of the old version can be efficiently withheld not to circulate in the financial market any longer.

The currency of four denominations are passed at present in Japan, and allowing for a future renewal in design of 10,000-yen bill, 5,000-yen bill and 1,000-yen bill, more than five stacking unit should be required, and the current requirement of five stacking units can be changed to any number for efficient processing if it is larger by one in number than the denominations of the currency increased in future.

What is claimed is:

1. A currency sorter comprising:

a take-in unit to take-in currency notes in the sorter one by one;

a discrimination unit to discriminate the currency notes according to a plurality of categories selected or combined from currency note conditions including new and old versions, fit and unfit conditions and denominations;

a plurality of stacking units to stack the currency notes of a predetermined category/categories designated to be bundled according to the discrimination results obtained by said discrimination unit, the number of said stacking units being greater by one than the number of denominations;

a bundling unit to bundle currency notes of predetermined number stacked in said plurality of stacking units;

a counter to count the currency notes stacked in said plurality of stacking units;

a conveying route to convey the currency notes from said take-in unit to said stacking units;

a designating unit to designate the category/categories of the notes to be bundled and a mode of sorting the notes to leave unbundled; and a control unit to control allocation of currency notes discriminated by said discrimination unit to one of said plurality of stacking units according to a designation by said designating unit, and for controlling taking-in operation of said take-in unit, such that after one of the stacking units becomes completely full, the extra stacking unit is substituted to stack the notes of the same denomination, and when stacking in the extra stacking unit, if it is detected that the remaining stacking units are about to be full by the counter, feeding mode of said conveying route is switched from "continual feeding" to "intermittent feeding" to confirm denomination by said discriminating unit and the substitution continues until new space generates in the extra stacking unit.

2. The currency sorter according to claim 1, wherein the control unit controls to cease the taking in of the notes, and the feeding mode of the conveying route when, by the counter, one of the stacking units is detected completely full, and one of the remaining stacking units is detected that was about to be full turns to be full.

3. The currency sorter according to claim 1, wherein there are four categories of the currency notes to be bundled while the stacking units are five in number.

* * * * *